US005775477A

United States Patent [19]

Brunn

[11] Patent Number: 5,775,477

[45] Date of Patent: Jul. 7, 1998

[54] DRIVE SYSTEM FOR CURVED ESCALATOR

[75] Inventor: Erik Brunn, Delmenhorst, Germany

[73] Assignee: O&K Rolltreppen GmbH, Hattingen, Germany

[21] Appl. No.: 633,824

[22] PCT Filed: Oct. 5, 1994

[86] PCT No.: PCT/EP94/03291

§ 371 Date: Apr. 9, 1996

§ 102(e) Date: Apr. 9, 1996

[87] PCT Pub. No.: WO95/10477

PCT Pub. Date: Apr. 20, 1995

[30] Foreign Application Priority Data

| | | | |
|---|---|---|---|
| Oct. 9, 1993 | [DE] | Germany | 43 34 449.6 |
| Oct. 25, 1993 | [DE] | Germany | 43 36 320.2 |

[51] Int. Cl.[6] ..... B66B 21/06

[52] U.S. Cl. ..... 198/328

[58] Field of Search ..... 198/328

[56] References Cited

U.S. PATENT DOCUMENTS

| | | | |
|---|---|---|---|
| 4,681,206 | 7/1987 | Sugita | 198/328 |
| 4,730,717 | 3/1988 | Sugita | 198/328 |
| 4,739,870 | 4/1988 | Saito | 198/328 |
| 4,775,043 | 10/1988 | Tomidokoro | 198/328 |
| 4,884,673 | 12/1989 | Rivera | 198/328 |
| 4,895,239 | 1/1990 | Johnson et al. | 198/328 |
| 4,930,622 | 6/1990 | Sansevero . | |
| 5,094,335 | 3/1992 | Adrian et al. | 198/328 |

FOREIGN PATENT DOCUMENTS

| | | | |
|---|---|---|---|
| 0118813A3 | 9/1984 | European Pat. Off. . | |
| 628965 | 4/1936 | Germany | 198/328 |
| 3432961 | 4/1987 | Germany . | |
| 59-74881 | 4/1984 | Japan . | |

*Primary Examiner*—D. Glenn Dayoan
*Attorney, Agent, or Firm*—Spencer & Frank

[57] ABSTRACT

A drive system for a curved escalator which has a frame, a transport section including steps, return tracks and guide tracks, and a drive connected to the transport section. The drive system includes: chain wheels connectable to the drive; and chains engaging the chain wheels hingeable in lateral edge areas of the steps, the chains being disposed parallel to one another, each of the chains comprising interior and exterior brackets. The drive system further includes shaft sections disposed adjacent corresponding ones of the brackets and further being adapted to be disposed at respective edge areas of each step; rollers connected to respective ends of each of the shaft sections, each of the shaft sections projecting through a corresponding one of the rollers and being fixed, at a face end thereof, in a wall area of a corresponding one of the interior brackets which is adapted to face outer frame areas of the frame; and traction rollers placed at a distance from the rollers. Bushings are respectively disposed at both end sections of the brackets. Each of the rollers includes a spherical bearing disposed therein, is seated in one dimension between corresponding ones of the interior brackets which are parallel to one another, is adjacent a corresponding one of the shaft sections, and is further seated in another dimension between corresponding ones of the bushings at both end sections of the brackets.

13 Claims, 7 Drawing Sheets

DRIVE SYSTEM FOR CURVED ESCALATOR

FIELD OF THE INVENTION

The invention relates to a drive system for a curved escalator with a frame, which is helically arranged in the vertical direction and contains a transport section for steps with a sector-shaped cross section, an upper and lower reversing section with chain wheels in connection with at least one drive, and return tracks for the steps, which can be driven by means of a plurality of chains, hinged in the lateral edge areas of the steps, arranged parallel with each other and formed by interior and exterior brackets, and wherein each step has in its respective edge area a shaft section equipped with a roller as well as a traction roller placed at a distance thereof, which roll off on guide tracks associated with them, wherein at least one of the respective end areas of the individual brackets and/or the associated shaft section is provided with a bushing containing a spherical bearing.

BACKGROUND OF THE INVENTION

Such a curved escalator was previously known from EP-B 118 813. A roller chain is provided on both sides of the steps, wherein each step has a step shaft connecting the roller chains. The connecting links of the chain formed from chain brackets are connected with the step shaft via the free end sections of each step shaft, or with each other, adjacent to the step shaft only by two spherical joints. The cylindrical exterior surface of the spherical joint connecting the connecting links with each other has essentially the same size as the rollers of the step chains such, that the cylindrical exterior surface can cooperate with the chain wheel like a roller of the step chain. With curved escalators, the drive chains are guided on a helically disposed track, wherein the rollers roll on corresponding guide tracks. The drive chains run at different circumferential speeds because of the diameter differences between the inner and outer area of the steps determined by the radius of the helices, so that when the track radii change, in particular in the transition and deflecting areas, deformation problems arise from the rise into the landing area, which cannot be completely overcome even by the proposed design.

A curved escalator can be found in DE-C 34 32 961, which includes a plurality of steps provided with step shafts, which are connected with each other by step chains. Support rollers are rotatably seated on the step shafts, wherein moreover guide rollers running on guide rails are provided which rotate around an axis perpendicularly with the step shafts. In this case the guide rollers are only provided on the ends of the step shafts toward the outside of the curve. With a conical arrangement of inner and outer gear wheels with different diameters in the deflecting areas, the bottom faces of the teeth are inclined at an angle with respect to a horizontal line. The step chains can be three-dimensionally deflected by means of a first connecting link, which is connected with the step shaft, and by means of a second connecting link, which adjoins the first connecting link. Besides the complicated structure of the drive system, it should be noted as disadvantageous that its function per se is questionable for the following reasons:

The speed differences of the step chains occurring in the deflecting areas because of the differences in diameter of the chain wheels cause an oppositely directed displacement of the step chains, particularly in the turning areas, by which considerable forces are created. Even though a certain amount of deformation is possible because of the use of two spatial bearing areas, it could not absorb the movement of the step chains against each other. This takes place in all areas of the curved escalator in which the angular speeds of the inner and outer step chain do not match. When the steps are tilted during running, the support rollers hinged on them naturally also run tilted, which causes considerable wear, and the run-up of the step chains on the respective chain wheel is subjected to considerable forcing which can even lead to a deformation of the step shafts.

SUMMARY OF THE INVENTION

It is the object of the invention to overcome the disadvantages of the prior art and to further develop the drive system in such a way that it is possible to realize a transition as free of forcing as possible, in particular in the transition and deflecting areas of the curved escalator.

This object is attained in accordance with the invention in that both end sections of the individual interior brackets are provided with bushings containing spherical bearings, and that the respective roller, which also has a spherical bearing, is seated on the one side between parallel interior brackets in the area of the associated shaft section, and on the other side is disposed between the respective bushings, having spherical bearings, of the respective end areas of the interior brackets.

Because each roller is disposed on the one hand between the interior brackets, and on the other hand is equipped with a spherical bearing, an essentially improved mobility of the entire components in respect to each other is achieved, besides a reduction of the structural space, so that in the transition and deflecting areas of the curved escalator in particular the forcing and deformation, which is undesirable there, can be optimally compensated without causing increased friction and/or deformations or damage of the corresponding components.

The respective shaft section preferably projects through the roller and terminates in the wall area of the interior bracket facing the outer areas of the frame without touching its front face, where it is then fixed in place by a snap ring, if required flush with the front face of this interior bracket.

Because of this measure it is possible to provide a support element for receiving upper and lower guide rollers in the area of this interior bracket without affecting the mobility of the respective shaft section. In this case the support element can be a separate body which is releasably connected with the associated bracket, or it can be formed by shoulders which, when the brackets are produced, for example by stamping, are formed directly thereon and are bent out in a further process step.

In contrast thereto, in EP-B 118 813 the support elements for the guide rollers are placed directly on the shaft ends outside of the rollers, so that it is possible there, too, for forcing to occur during the spatial movement of the respective drive chain and the deformations connected therewith, which have a disadvantageous effect on the running behavior of the guide rollers. This condition is assuredly prevented by means of the spatial and functional separation between the shaft section and the guide rollers.

A drive system, wherein the respective reversing section of the curved escalator is formed by two spaced-apart chain wheels of different diameters, which can be respectively connected with each other by a shaft and which are provided at the outer circumference with a plurality of rounded recesses receiving the bushings for deflecting the chains, contains as a function of the chain pitch a further recess in the area of the respective chain wheel, whose reference diameter is less than that of the bushings, for receiving and guiding the roller disposed between the bushings. It is assured by this measure that the interior brackets, which respectively contain a roller, can be also deflected without problems.

Such a drive system furthermore contains a drive in the areas of at least one of the reversing sections, whose drive shaft receives the chain wheels, wherein one of the chain wheels, in particular the one with the lesser diameter, can be displaced in the circumferential direction in respect to the other chain wheel. This can be accomplished by means of elongated slots, for example, into which bolts of the drive shaft extend. In this case the angular offset of the one chain wheel in respect to the other can be calculated and set as a function of the diameters of the chain wheels and the different speeds of the inner and outer chains. The chain wheels of the non-driven reversing section are seated to be freely rotatable on their shafts. It is possible that, as a function of the diameter differences, the outer chain runs approximately 10 to 15% faster than the inner one, wherein the chains are intended to run up on the associated chain wheel in a straight line and not obliquely. This speed difference is taken into consideration by means of the relative displaceability of the two chains in respect to each other, so that both chains can run up evenly and straight on the associated chain wheel. Forcing is assuredly prevented in this way.

In accordance with a further concept of the invention, engagement elements are provided in the area of the chain wheels, which are used for receiving and guiding the traction rollers provided in the area of the steps. This measure results in a forced guidance of the respective step in the deflection area, by means of which the safety in case of a possible tilted movement of the step is increased. The engagement elements can be individual elements which are manufactured following the determination of the envelope of the course of the turning of the traction roller shaft, and are provided in the area of the chain wheels. There is the alternative option to cut the engagement elements, for example in the form of grooves, in separate disks, which are then placed on the shafts and connected with the chain wheels.

BRIEF DESCRIPTION OF THE DRAWINGS

The invention is represented in the drawings by means of an exemplary embodiment and will be described as follows. Shown are in.

DETAILED DESCRIPTION OF THE INVENTION

Figure 1:
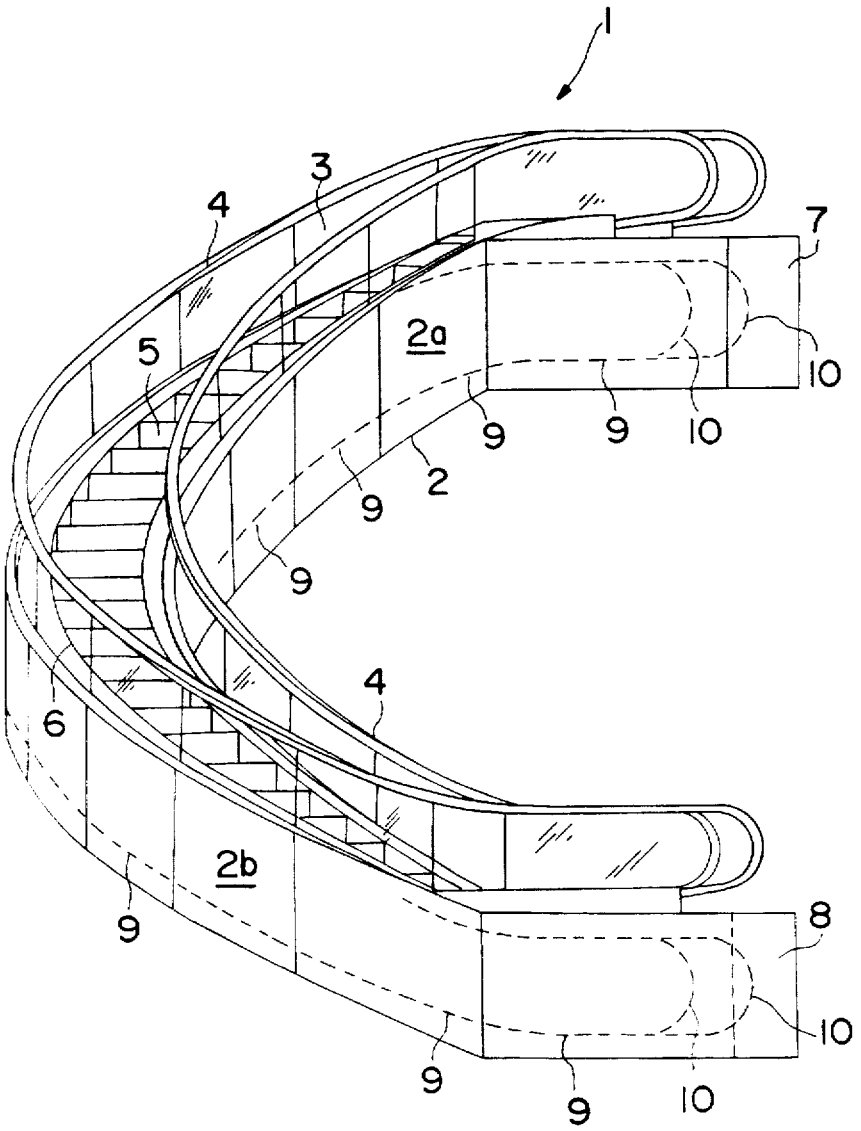
FIG. 1, a basic sketch of a curved escalator.

FIG. 1 shows, in the form of a basic sketch, a curved escalator 1 which essentially comprises the following components:

A base 2, extending helically in the vertical direction, which constitutes the frame for the curved escalator 1 and receives the essential drive elements, exterior frame sides 2a, 2b, an analogously helically-designed balustrade 3, including handrails 4 and steps 5, which form a transport section 6, and an upper and a lower reversing section 7, 8, as well as return tracks 9 for the drive chains 10, shown schematically, in the area of the helices.

Figure 2:
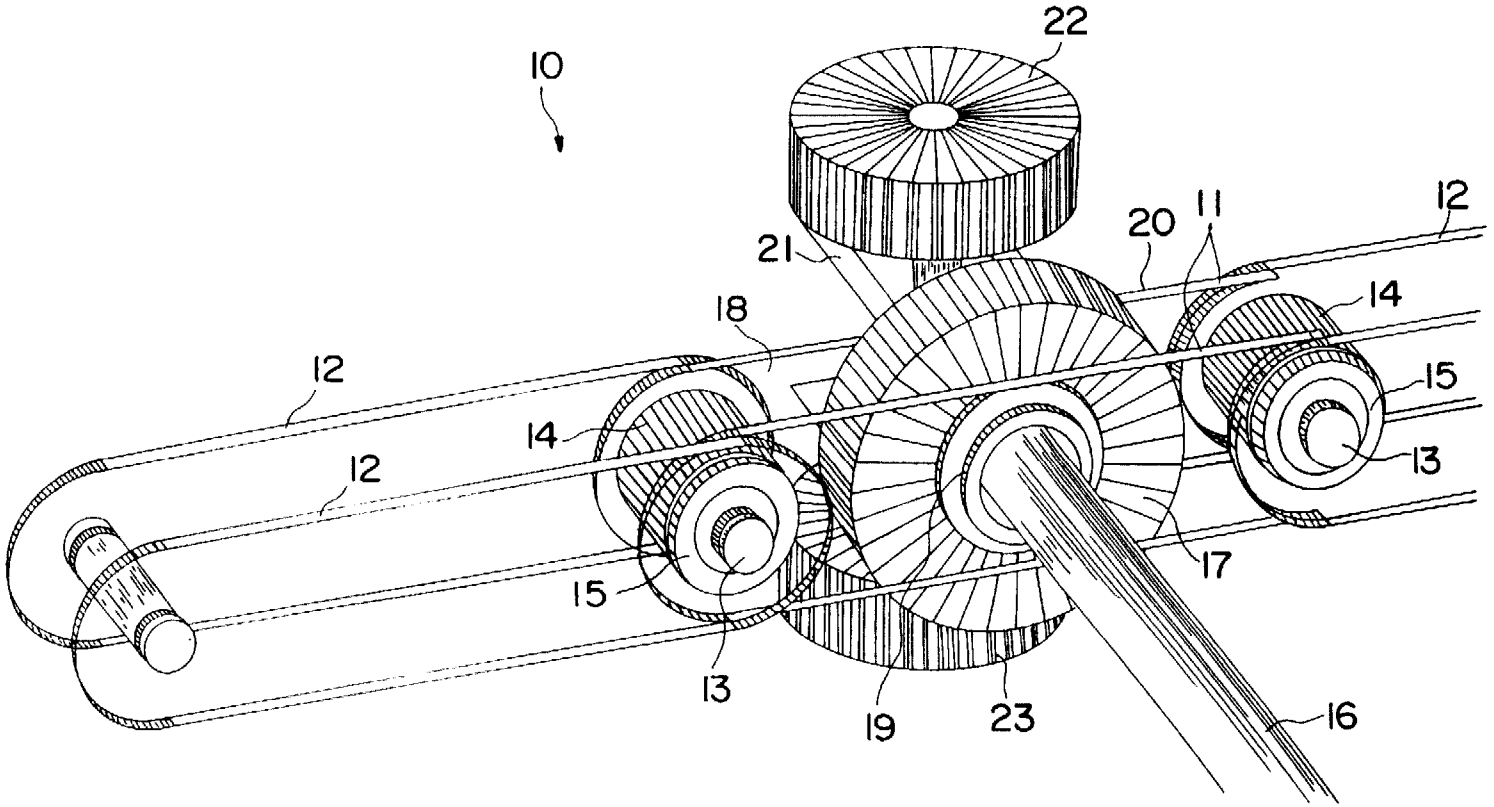
FIG. 2, a perspective partial representation of a drive chain which is a part of the drive system, FIG. 3, a schematic, side elevational view of the drive chain of FIG. 2, FIG. 4, a schematic, top plan view of the drive chain of FIG. 3, FIG. 5, a representation of a chain wheel which is part of the drive system, FIG. 6, a schematic representation of a reversing section, FIG. 7, chain wheels of a reversing section, offset in the circumferential direction, FIG. 8, a representation of an engagement disk for the traction rollers of the steps.

FIG. 2 shows in a perspective partial representation a drive chain 10 including a plurality of connected interior brackets 11 and outer brackets 12, which are connected with each other in their end areas by means of bolts 13. The bolts 13 are surrounded by a bushing 14 in the areas of the interior brackets 11, wherein a spherical bearing 15 respectively extends between the bolts 13 and the bushings 14. In the area of the step, not shown in detail here, and on both sides thereof, there is a shaft section 16, extending in the direction of the associated bracket chain 10. A roller 17 disposed between the spaced-apart interior brackets 11 extends on the step side between respectively two bushings 14 containing spherical bearing 15, wherein the shaft section 16 extends through the interior bracket 11 and the roller 17 on the one side and terminates on the other side in the wall section 18 of the interior bracket 11, where it is fixed in place, for example by means of a snap ring, not further represented here. Analogously with the bolts 13, each roller 17 also contains a spherical bearing 19, so that an optimum spatial mobility of this drive chain 10 is provided. Respectively one support element 21 is provided in the area of the free front face 20 of the interior brackets 11 and is releasably connected with the associated interior bracket 11. The support element 21 is used to receive upper and lower guide rollers 22, 23, which are intended for lowering forces acting from the outside and rolling off on guide profiles, not further represented here.

Figure 3:
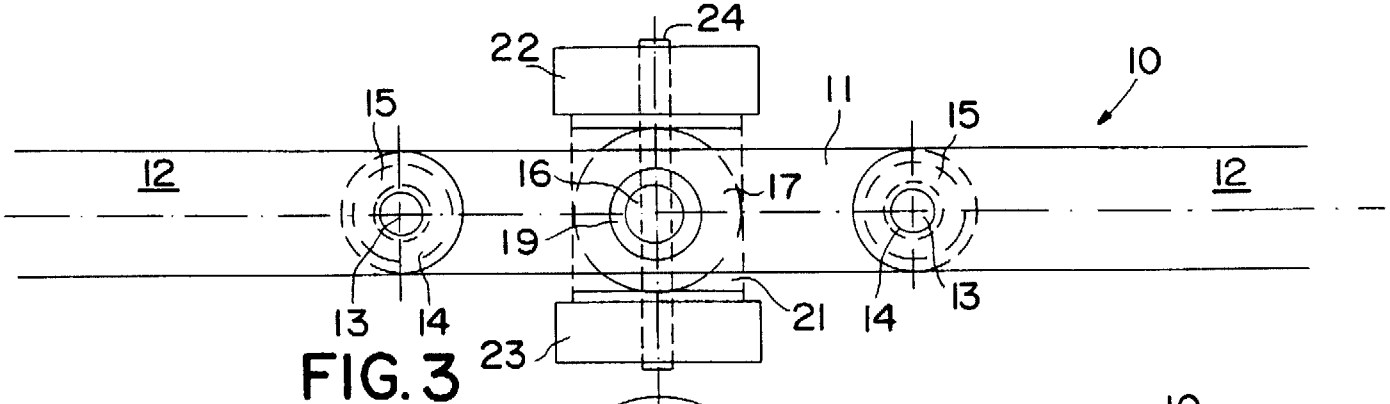
Figure 4:
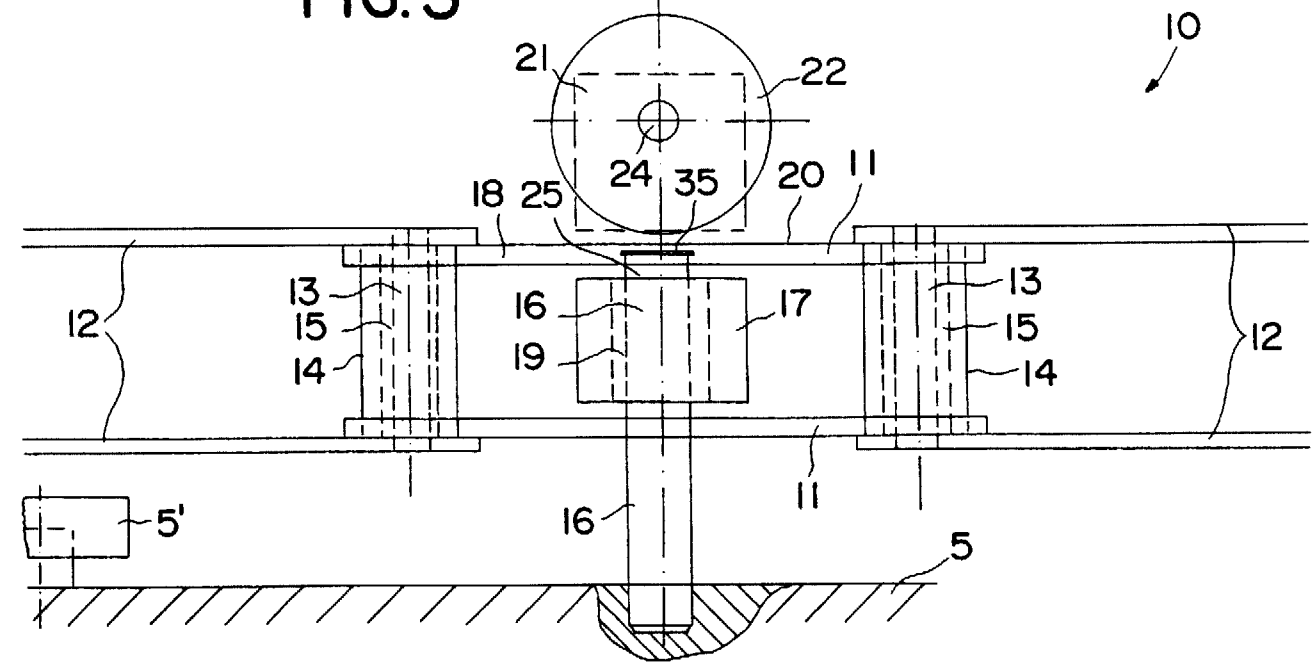

FIGS. 3 and 4 show, one in a side view and the other in a top view, a partial area of the drive chain 10 of FIG. 2. The interior brackets 11 and the exterior brackets 12 can be seen, the bolts 13 as well as the bushings 14 surrounding them, and the spherical bearings 15, the roller 17, the shaft section 16 extending into the area of a merely sketched-in step 5 and traction roller 5', the support element 21 and the guide rollers 22, 23 fastened by means of a pin 24 in the support element 21. The front face 25 of the shaft section 16 ends in the wall area 18 of the respective interior bracket 11 without penetrating through the front face 20 there, and is fixed in place there by means of a snap ring 35.

Figure 5:
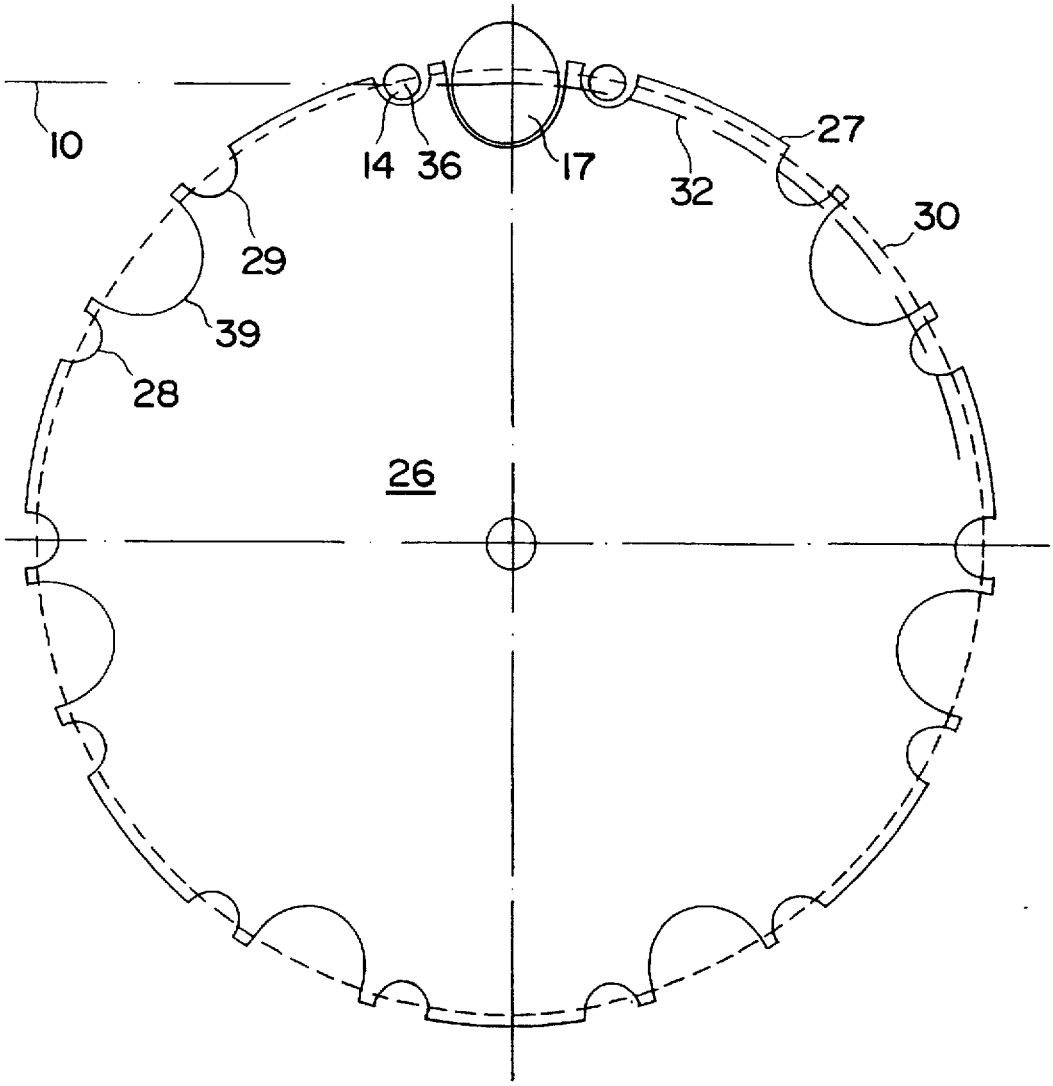

FIG. 5 shows, as a further component of the drive system in accordance with the invention, a chain wheel 26 provided in the respective reversing section. The run-up area of the bracket chain 10, not further shown here, is indicated by dash-dotted lines. Recesses 28, 29, matched to the diameter of the bushings 14, are disposed on the circumference 27 of the chain wheel 26 for receiving the bushings 14 of the bracket chain 10, wherein the dashed section 30 represents the reference circle of the bushing shaft 36. A deeper recess 31 is provided between the recesses 28, 29 and is used for receiving the roller 17, whose reference circle 32 has a smaller radius than the circle 30 of the bushing shaft 36.

Figure 6:
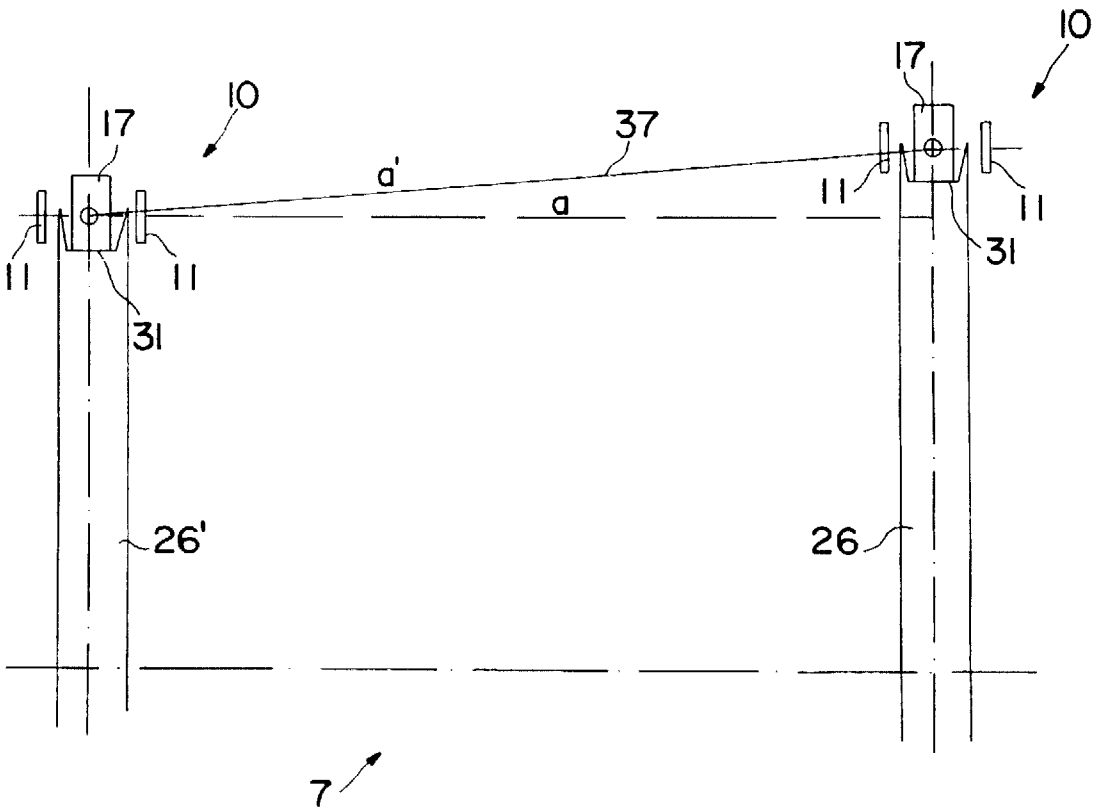

FIG. 6 shows a basic sketch of a reversing section 7, which contains two chain wheels 26, 26' of different diameters, connected with each other by a shaft 37. The recesses 31 for receiving the rollers 17, which are held between the interior brackets 11, can be seen. Because of the diameter difference between the outer and inner chain wheels 26, 26', the smaller, inner chain wheel 26', as a function of the diameter difference, runs 10 to 15% faster than the outer one, 26. Accordingly, the distance a' of the shaft 37 is greater than the distance a would be with chain wheels of the same size. Since the chains 10 are not intended to run up obliquely, but straight, on the associated chain wheel 26, 26', it is necessary to take these parameters also in account, which will be explained in FIG. 7.

Figure 7:
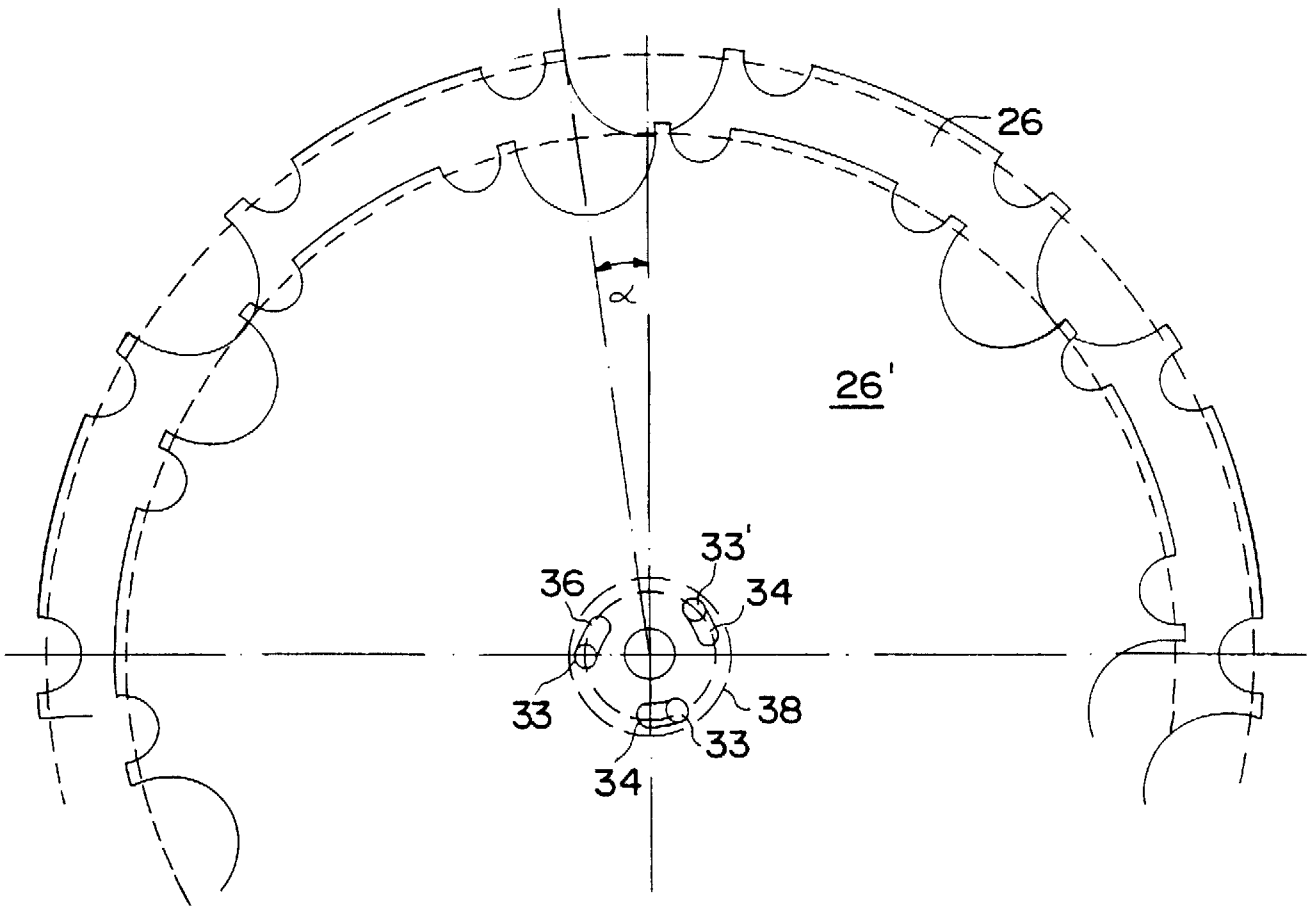

FIG. 7 shows the arrangement of an outer and an inner chain wheel 26, 26'. In order to overcome the problems indicated in FIG. 6, the drive shaft 38, only sketched in here, is provided with bolts 33 in the area of the smaller chain wheel 26', which are guided in elongated slots 34 of the smaller chain wheel 26', so that it is possible to perform an optimal adjustment of the two chain wheels 26, 26' in respect to each other prior to start-up, and the chains (not shown) can run up evenly and straight on the chain wheels 26, 26'. In this case the respective angle of displacement alpha is a function of the diameter difference between the chain wheels 26, 26', and of the length difference of the distances a, a' in accordance with FIG. 6.

Figure 8:
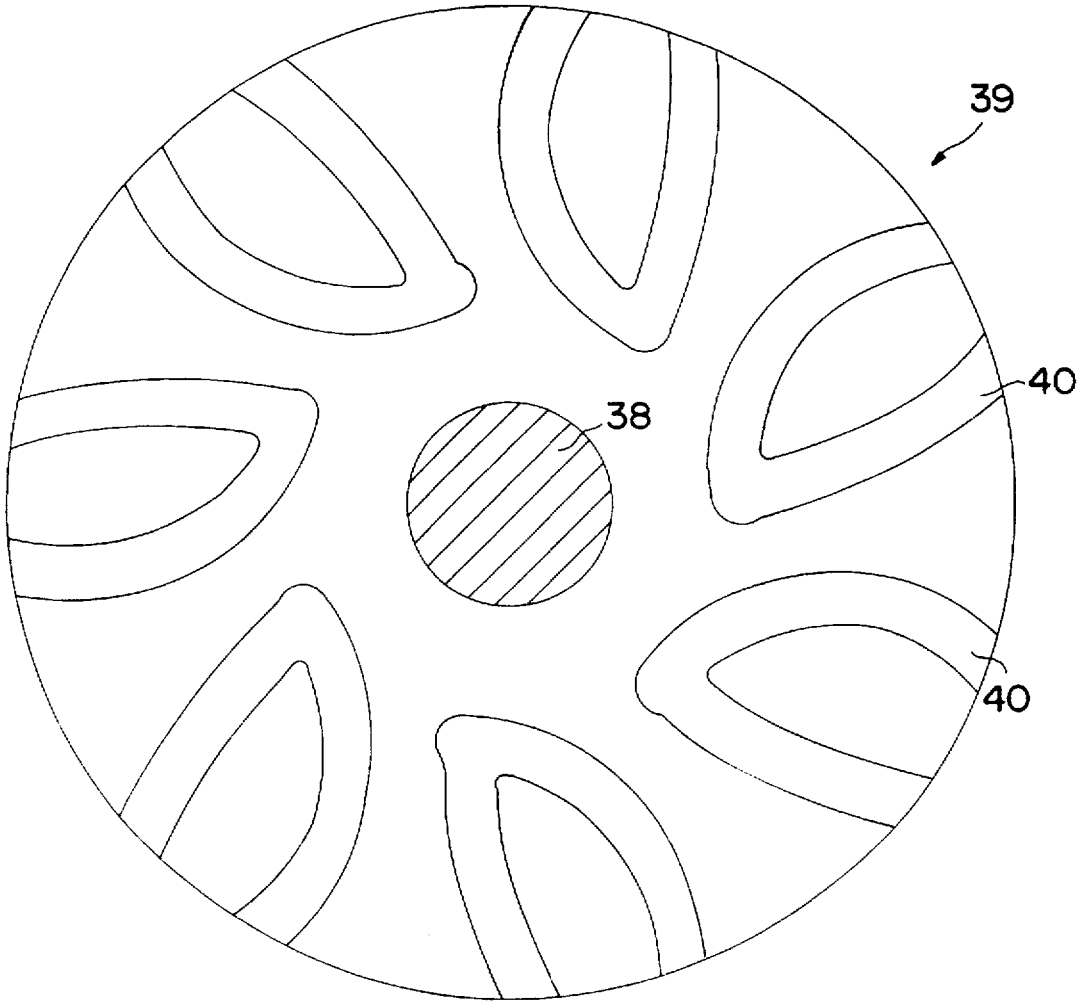

FIG. 8 shows an engagement disk 39 for the traction rollers, not shown here, of the step 5 which, for example, can be placed on the drive shaft 38 and connected with the associated chain wheel 26, 26' (not shown). Engagement elements 40 in the form of grooves have been cut into the engagement disk 39 and correspond to the roll-off geometry of the traction rollers when the steps 5 rotate around the chain wheels 26, 26' in the area of the respective reversing section.

I claim:

1. A drive system for a curved escalator having a frame helically arranged in a vertical direction, a transport section disposed on the frame and including steps, return tracks and guide tracks for the steps disposed on the frame, and a drive connected to the transport section for driving the transport section, the drive system comprising:

a plurality of chain wheels adapted to be connected to the drive for being driven thereby;

a plurality of chains engaging the chain wheels and adapted to be hinged in lateral edge areas of the steps for diving the steps, the chains being disposed parallel to one another, each of the chains comprising a plurality of individual brackets including:

a plurality of interior brackets; and a plurality of exterior brackets disposed adjacent the interior brackets;

a plurality of shaft sections disposed adjacent corresponding ones of the individual brackets and further being adapted to be disposed at respective edge areas of each of the steps;

a plurality of rollers connected to respective ends of each of the shaft sections and being adapted to roll off corresponding ones of the guide tracks, each of the shaft sections projecting through a corresponding one of the rollers and terminating, at a face end thereof, in a wall area of a corresponding one of the interior brackets which is adapted to face outer frame areas of the frame, the face end of said each of the shaft sections being fixed at the wall area;

a plurality of traction rollers placed at a distance from the rollers and adapted to roll off corresponding ones of the guide tracks;

at least one bushing disposed at at least one end section of one of the individual brackets and corresponding shaft sections; and a spherical bearing disposed in each of the at least one bushing;

wherein:

the at least one bushing comprises a plurality of bushings respectively disposed at both end sections of the individual brackets; and each of the plurality of rollers includes a spherical bearing disposed therein and is seated in one dimension between corresponding ones of the interior brackets, the corresponding ones of the interior brackets being parallel to one another, said each of the plurality of rollers further being adjacent a corresponding one of the plurality of shaft sections and further being seated in another dimension between corresponding ones of the bushings disposed at both ends sections of the individual brackets.

2. The drive system according to claim 1, further comprising a snap ring for fixing the face end of said each of the shaft sections at the wall area.

3. The drive system according to claim 1, further comprising:

a plurality of support elements, each of the support elements being connected to a corresponding one of the interior brackets at a region outside of the face end of said each of the shaft sections; and a plurality pairs of guide rollers, each of the pairs of guide rollers comprising an upper guide roller and a lower guide roller, the guide rollers being supported by the support element.

4. The drive system according to claim 3, wherein the support element is releasably connected to a corresponding one of the interior brackets.

5. The drive system according to claim 1, further comprising:

a pair of reversing sections including an upper reversing section and a lower reversing section both adapted to be disposed on the frame, each of the reversing sections being formed by a pair of chain wheels of the plurality of chain wheels, the pair of chain wheels comprising two spaced-apart chain wheels having different diameters, each of the two spaced-apart chain wheels defining at an outer circumference thereof:

a plurality of rounded recesses receiving corresponding ones of the bushings therein for deflecting the chains;

a plurality of roller recesses disposed between two immediately succeeding ones of the rounded recesses as a function of a pitch of the chains for guiding a corresponding one of the plurality of rollers, a reference diameter of each of the roller recesses being less than a reference diameter of the bushings; and a plurality of shafts, each of the shafts connecting corresponding ones of the two spaced-apart chain wheels with one another.

6. The drive system according to claim 1, further comprising means for displacing one of the two spaced-apart chain wheels in a circumferential direction with respect to another one of the two spaced-apart chain wheels.

7. The drive system according to claim 6, wherein said one of the two spaced-apart chain wheels has a smaller diameter than that of said another one of the two spaced-apart chain wheels.

8. The drive system according to claim 6, wherein the means for displacing is configured as a function of an angular offset of said one of the two spaced-apart chain wheels with respect to said another one of the two spaced-apart chain wheels, the angular offset being adapted to be calculated and set as a function of a diameter difference between the two spaced-apart chain wheels and of a speed difference between an inner one and an outer one of the chains.

9. The drive system according to claim 5, further comprising a plurality of engagement elements disposed adjacent corresponding ones of the chain wheels for guiding the traction rollers, the traction rollers being adapted to be disposed on the steps.

10. The drive system according to claim 9, further comprising a plurality of engagement disks, the engagement elements being disposed on corresponding ones of the engagement disks.

11. The drive system according to claim 10, wherein the engagement elements comprise a plurality of guide grooves defined in corresponding ones of the engagement disks.

12. The drive system according to claim 10, wherein the engagement disks are disposed on corresponding ones of the shafts.

13. The drive system according to claim 10, wherein the engagement disks are connected with corresponding ones of the chain wheels.

* * * * *